United States Patent [19]

Beebe

[11] Patent Number: 4,723,233

[45] Date of Patent: Feb. 2, 1988

[54] MAGNETICALLY CONTROLLED ARRHYTHMICAL PENDULUM DEVICE

[76] Inventor: William B. Beebe, 2832 Main St., Bethlehem, Pa. 18017

[21] Appl. No.: 7,726

[22] Filed: Jan. 27, 1987

[51] Int. Cl.[4] ..... G04B 19/00; G04B 17/02; G09F 19/00

[52] U.S. Cl. ..... 368/76; 368/179; 368/223; 40/426; 40/485

[58] Field of Search ..... 368/10, 76, 134–137, 368/165–166, 179–182, 223; 40/426, 485; 185/29; 272/1, 85

[56] References Cited

U.S. PATENT DOCUMENTS

| | | | |
|---|---|---|---|
| 1,483,814 | 2/1924 | Juruick | 368/134 |
| 1,933,087 | 10/1933 | Battegay | 368/134 |
| 3,903,624 | 9/1975 | Wilson | 368/179 |
| 4,011,674 | 3/1977 | Jacobson | 40/426 |
| 4,121,416 | 10/1978 | Niemczyk | 368/88 |
| 4,417,725 | 10/1981 | Van Horn | 272/85 |
| 4,544,282 | 10/1985 | Giraldez | 368/165 |

*Primary Examiner*—Vit W. Miska

*Attorney, Agent, or Firm*—Charles A. Wilkinson

[57] ABSTRACT

A display or other type device having intrinsic attention attracting properties and eye appeal is provided in the form of a pendulum type device arranged so the pendulum has an arrhythmic movement in time and/or in space and time. The pendulum may be deviated to one side in its oscillations, and/or temporarily halted at the end of some or all of its oscillations, such unexpected deviations in space and/or in time serving to catch and hold the observer's attention or otherwise amuse onlookers. The arrhythmic movements of the pendulum are controlled by electromagnetic means positioned near the end of the oscillation trajectory of the pendulum.

17 Claims, 20 Drawing Figures

FIG. 1
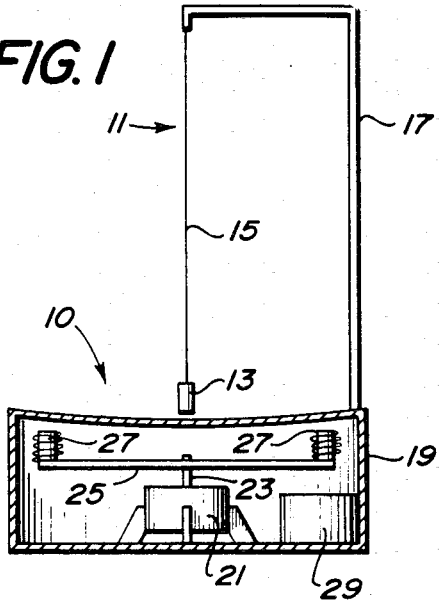
FIG. 3
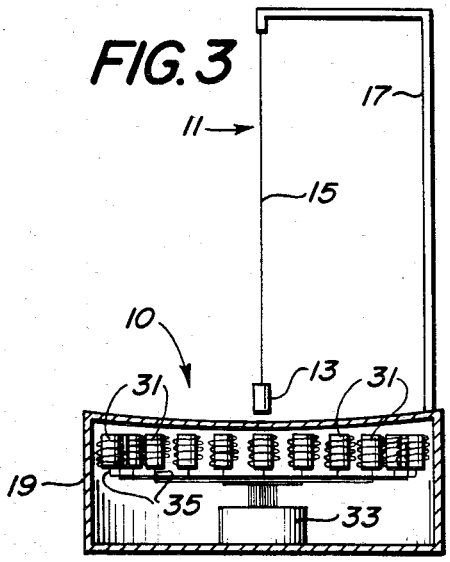
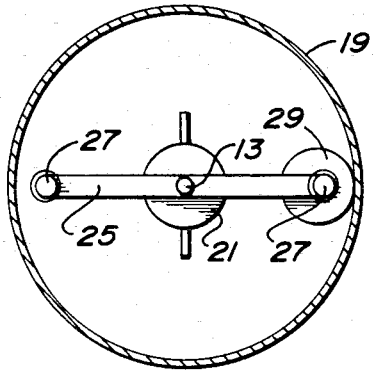
FIG. 2
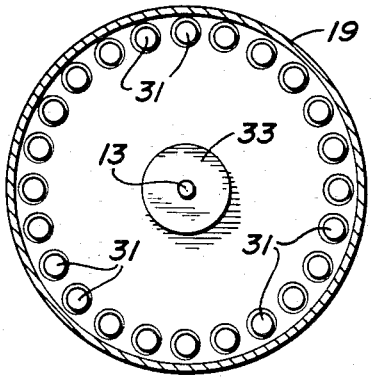
FIG. 4
FIG. 5
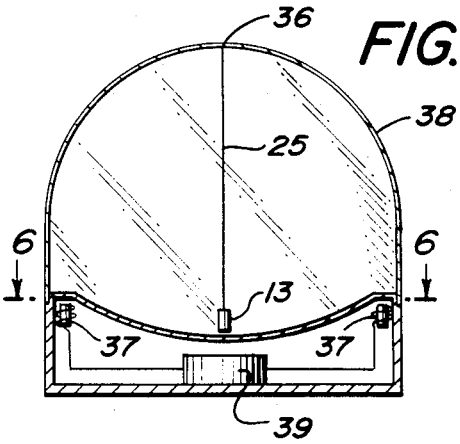
FIG. 6
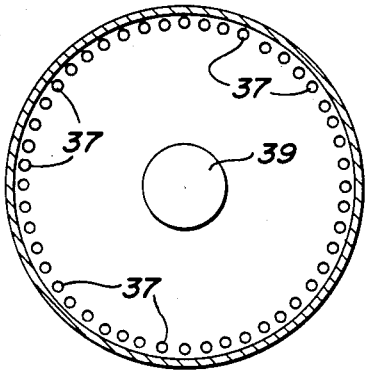

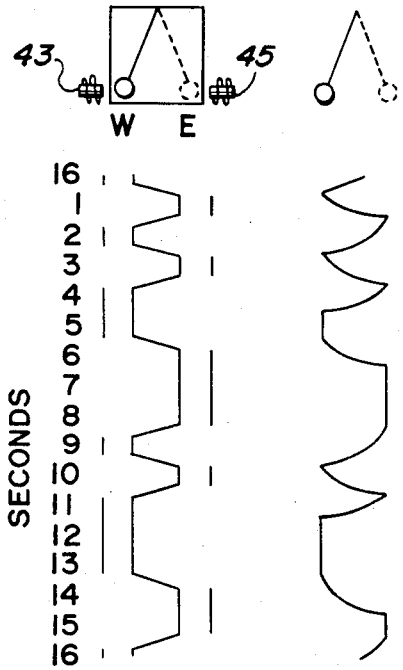
FIG. 10a
FIG. 10b
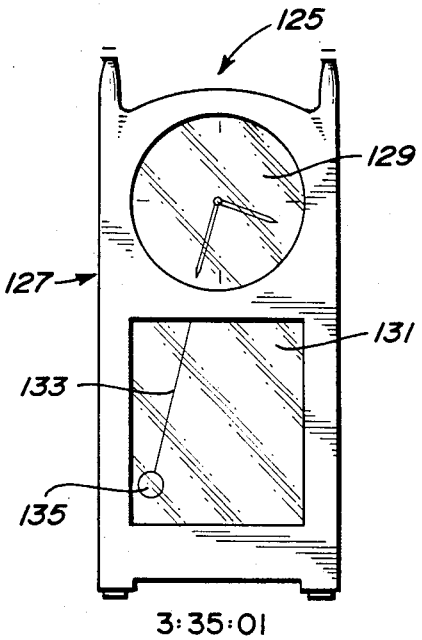
FIG. 17a
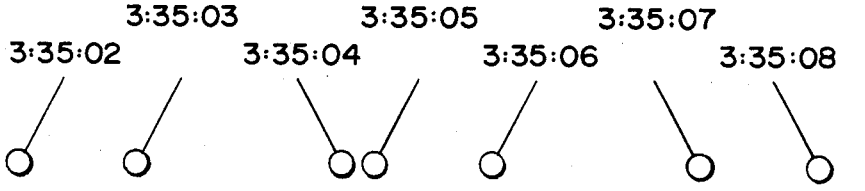
FIG. 17b

MAGNETICALLY CONTROLLED ARRHYTHMICAL PENDULUM DEVICE

CROSS REFERENCES TO RELATED APPLICATIONS

This application is one of four related applications for patents concurrently filed by the present inventor, the related applications being for a Pendulum Indicator Horological Device, a Pendulum Type Decorative and Time Indicating Device, and a Decorative Horological Device, the latter application being a design application.

BACKGROUND OF THE INVENTION

1. Field of the Invention

This invention is generally directed to pendulum type devices and is more particularly directed to a decorative display type device utilizing an arrhythmic pendulum motion. More particularly still the invention is directed to a display device utilizing a pendulum the swing of which is partially or wholly regulated to oscillate or swing in a predetermined pattern in time or in space and time.

2. Description of the Prior Art

It is frequently desired to provide a display or novelty type device which has an eye-catching, attractive or unusual movement or which simulates the movement of animate or motor activated objects of substantially the same or larger scale. Many such devices have made use of magnetic type motion inducing means. Exemplary disclosure of such devices may be found in the following U.S. patents:

U.S. Pat. No. 1,167,020 issued Jan. 4, 1916 to W. G. Reuter discloses a magnetic display device in which an electromagnet is moved in a pattern beneath a base and a magnetic follower rolls on the base over the electromagnet.

U.S. Pat. No. 1,126,373 issued Jan. 26, 1915 to L. M. Bowman discloses a device somewhat similar to the Reuter device, but including an intermittently activated electromagnet which carries objects only part way about the surface.

A number of such magnetically actuated devices have made use of suspended objects or figures. Exemplary disclosures of such devices are to be found in the following U.S. patents:

U.S. Pat. 2,220,040 issued Oct. 14, 1940 to F. W. Dunmore discloses a moving magnet beneath a base which attracts and moves a suspended figure in a pattern over said base.

U.S. Pat. No. 3,425,157 issued Feb. 4, 1969 to W. H. Hartsock discloses a toy device in which eccentrically disposed magnets on a horizontal shaft induce complicated motions of suspended figurines.

U.S. Pat. No. 3,874,102 issued Apr. 1, 1975 to E. H. Sheppard discloses an arrangement of a magnetic novelty in which an electromagnet beneath a base causes an allegedly realistic motion of a simulated fish suspended on a line.

U.S. Pat. No. 4,250,659 issued Feb. 17, 1981 to T. Ishiguro discloses a magnetically actuated toy in which a figure is suspended and swings like a pendulum across a base. Magnetic means in the base deflects the normal swing of the figure into various undefined patterns.

It has also been known for many years to use pendulum type action as eye-catching or decorative type devices in which a regular or periodic oscillation of a pendulum attracts or holds the attention in addition to the use of a pendulum in mechanical movement type devices where the inherent periodicity of the pendulum movement serves as a timing or motion regulating device. Pendulum clocks are a well known application of the pendulum motion principle and dummy pendulums having no time keeping or horological function, but in which the pendulum merely mimics the normal utilitarian function of the pendulum or serves as an eye attracting movement associated with the horological device are also well known. Exemplary disclosures of such devices may be found in the following U.S. patents:

U.S. Pat. No. 2,722,097 issued Nov. 1, 1955 to E. Lefrand discloses a conical pendulum alternating current clock wherein the pendulum motion both drives and regulates the clock mechanism. In the Lefrand device the clock is controlled by the frequency of a pendulum formed of electrically conductive material and caused to swing in a conical path by means of a rotating or oscillating electric field, as in an induction motor.

U.S. Pat. No. 2,995,005 issued Aug. 8, 1961 to R. L. Boyles describes a simulated swinging pendulum clock, "the pendulum motion of which is utilized for other than timekeeping purposes and does not control the operation of the clock mechanism."

U.S. Pat. No. 3,762,154 issued Oct. 2, 1973 to C. Petrides is directed to a simulated pendulum clock wherein the "pendulum is functionally separated from a timekeeping movement for driving the hands of the clock."

U.S. Pat. No. 3,762,155 issued Oct. 2, 1973 to C. B. Marble is also directed to a pendulum clock wherein the pendulum is functionally separated from the timekeeping movement which drives the hands of the clock. The '155 patent is particularly directed to a pendulum arm with an upper pendulum drive arm having a permanent magnet positioned adjacent to an electromagnetic movement for driving the pendulum and a lower pendulum arm removably connected to the upper pendulum arm.

U.S. Pat. No. 3,903,684 issued Sept. 9, 1975 to A. Wilson discloses a pendulum type time or interval keeper in which the swing of a pendulum per se indicates elapsed periods of time. The pendulum includes a magnetic means which interacts with a second magnetic means mounted on the base in a keeper. The magnetic means is not used for adding energization to the swings of the pendulum or determining the position to which the pendulum swings, but serves instead to operate the keeper at the conclusion of movement.

U.S. Pat. No. 3,924,401 issued Dec. 9, 1975 to E. Heim discloses the provision of a dummy torsion pendulum (as opposed to an oscillating pendulum) under a clock mechanism.

U.S. Pat. No. 4,121,416 issued Oct. 24, 1978 to C. Niemczyk discloses a dummy oscillating pendulum periodically energized by solenoid coil means energized momentarily during the pendulum oscillations by contact switch means.

U.S. Pat. No. 4,203,282 issued May 20, 1980 to B. Radzun is broadly similar to the dummy torsion arrangement shown in U.S. Pat. No. 3,924,401 to Heim described above.

U.S. Pat. No. 4,417,725 issued Oct. 19, 1981 to J. Van Horn discloses a novelty device in which two suspended objects after activation swing about each other.

FIG. 20 shows the intervention of magnetic means in the movement of the objects.

U.S. Pat. No. 4,468,132 issued Aug. 28, 1984 to N. Nakamura discloses a swinging body clock in which oscillation of the body of the clock as well as an attached pendulum is effected by magnetic means hidden within or behind the clock case.

While the above described devices have provided a varied repertory of attention attracting display and other devices, each has had certain disadvantages. For example, regular motion type pendulum devices, while useful in time keeping or measuring applications, and while they have a certain restful or almost hypnotic effect upon the viewer, by their very regular movement tend to lose their attention attracting ability. This is because one quickly memorizes or becomes accustomed to the regular movement and such movement, unless consciously attended to, blends into the background and is no longer noticed. On the other hand, more or less random movements such as are attained, or intended to be attained, in devices such as disclosed, for example, in U.S. Pat. No. 2,200,049 to Dunmore, U.S. Pat. No. 3,425,157 to Hartsock, U.S. Pat. No. 4,417,725 to Van Horn and U.S. Pat. No. 4,250,659 to Ishiguro described above, are in general too variable to be reliable and yet tend to degenerate by statistical chance into a stereotyped repetitive pattern unless there is periodic manual intervention in the swing of the objects. There have also been devices which add periodic impetus to a regularly oscillating pendulum type device to maintain movement by compensating for dissipation of the kinetic energy by air resistance and other frictional effects. Pendulum clocks are frequently provided with such energy dissipation compensation devices. However, no device has been available, so far as the present Applicant is aware, in which a swinging pendulum type device is made to swing arrhythmically or aperiodically in a predetermined pattern or a machine generated random pattern by magnetic or other means.

SUMMARY OF THE INVENTION

The present invention provides a new, eye-catching and attractive pendulum type device in which the pendulum is provided with a predetermined arrhythmic movement by magnetic means. In its simplest implementation the device provides a swinging pendulum supported from a suitable support and acted upon at least at one end of its swing by an electromagnet which interrupts the regular swing of the pendulum bob by momentarily or temporarily interrupting the swing of the pendulum by maintaining it at one end of its normal swing for a greater period than would be the case for its natural period of oscillation or by both interrupting the normal swing of the pendulum and at the same time deviating it to the side.

The magnetic means, which is in the form of an electromagnetic means, is controlled by an interrupt means or timer to activate or deactivate it. The magnetic means may also be carried by a transport means to the side of the normal swing path of the pendulum. The magnetic means may both move or deviate the pendulum bob to the side and operate intermittently to temporarily interrupt the pendulum path at the same time. If the pendulum is restricted to a single plane of movement by its pivot arrangement, which would be similar to the usual arrangement in a swinging pendulum type clock, for example, the magnetic means will, of course, not move laterally but will merely be activated in an intermittent or interruptive manner.

A viewer normally expects a pendulum to swing in a predictable manner with which almost all persons are so familiar that they can automatically estimate the pendulum's position and speed at any given moment. In other words, the viewer will know where the pendulum should be at any given moment. If such expected pattern is seriously deviated or interrupted, it will immediately catch the eye of the viewer because an unexpected movement tends to be immediately noted by the neural pathways of the brain. Because of this peculiarity of the normal human brain, any arrhythmic or asynchronous movement of a pendulum type device tends to be immediately noticed by a viewer and if the arrhythmic movement is sufficiently unusual, such movement will be inherently fascination inducing and eye-catching. Of course, a pre-programmed movement, unless deliberately random, will almost inherently have some detectable pattern after a greater or lesser period. However, the very predictable oscillations of a pendulum are so well known and fixed in the mind of anyone who has seen one for even a short time that even a small deviation from such pattern will be attention attracting even though the deviation itself may have a detectable pattern. Of course, the more complicated the pattern the longer it will take for such pattern to become routine to the viewer. However, for the casual passerby even an uncomplicated deviation of a pendulum in time or space may be very attention riveting and, particularly if the device is being used to attract attention to advertisements or the like, may be even more useful than a very complicated deviation, since the more complicated deviation may have so much inherent interest in itself that it draws attention from the more important advertising material. In any event, it should be understood that when an arrhythmic movement of the pendulum bob is referred to it is meant that such pendulum moves with an abnormal arrhythmic motion for a pendulum and not necessarily that the movement itself is absolutely without rhythm or sequential pattern of any kind.

Various embodiments of the basic arrhythmic pendulum of the invention may be constructed and used in which magnetic means, usually of the electromagnetic type, are arranged at one or both ends of the swing of the pendulum bob. There may be only one magnetic means at each end or there may be multiple magnetic means at each end, usually arranged in an arc closely adjacent to the swing of the pendulum so such pendulum can be deviated to the side and in effect passed from the influence of one magnet to the influence of an adjacent magnet.

It is a principal object of the present invention therefore, to provide an attention attracting or display device incorporating a pendulum swinging with an abnormal or arrhythmic pattern of movement.

It is a still further object of the invention to provide a pendulum type device with magnetic means for controlling the period of the swing of the pendulum in either a regular or arrhythmic pattern.

It is a still further object of the invention to provide a pendulum type device which swings freely, but in which the period of swing is programmable to provide variations of the period ranging from a normal rhythmic period, i.e. a regular period of back and forth pendulum motion to an abnormal or arrhythmic, or highly arrhythmic, pendular motion.

It is a still further object of the invention to provide a pendulum type device with a magnetic means for controlling the direction of the swing of the pendulum either in a normal pattern or in an abnormal pattern.

It is a still further object of the invention to provide a pendulum type device with a magnetic means for determining both the period and the direction of a pendulum swing It is a still further object of the invention to provide a novel attention attracting or display device making use of an unusual or seemingly abnormal pendulum action to attract and hold the attention of a passerby.

Other objects and advantages of the invention and its variations will become evident from the following description and drawings.

BRIEF DESCRIPTION OF THE DRAWINGS

FIG. 1 is a broken away view of one embodiment of the invention.

FIG. 2 is a broken away plan view of the invention shown in FIG. 1.

FIG. 3 is a broken away view of a further embodiment of the invention.

FIG. 4 is a broken away plan view of the base of the embodiment of the invention shown in FIG. 3.

FIG. 5 is a cross sectional elevation of a still further embodiment of the invention.

FIG. 6 is a broken away plan view of the base of the embodiment of the invention shown in FIG. 5.

FIG. 10 is a diagrammatic representation of the definition of the cam arrangement shown in FIG. 7 plus the arrhythmic pendular oscillations resulting. FIG. 10*a* shows the cam definition while FIG. 10*b* graphically depicts the pendulum oscillations.

FIGS. 17*a* and 17*b* show respectively the use of the arrhythmic pendulum of the invention with the pendulum of a dummy grandfather's clock and one example of an arrhythmical oscillation sequence of such dummy clock pendulum.

DESCRIPTION OF THE PREFERRED EMBODIMENTS

Figure 7:
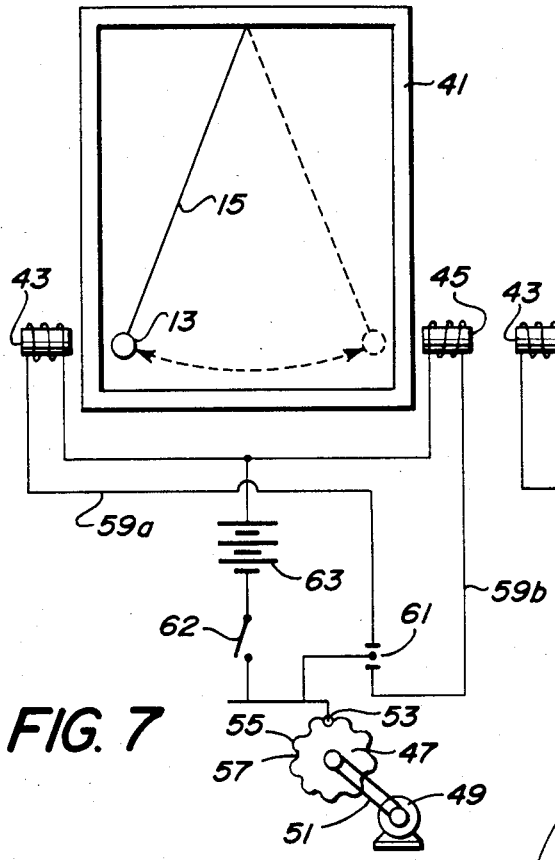
FIG. 7 is a schematic diagram of a further embodiment of the invention using a mechanical timing arrangement.

Freely swinging pendulums assume regular periodic oscillations dictated by the length of the pendulum bob suspension, i.e. the longer the pendulum, or pendulum bob suspension, the shallower the arc and the longer the period of oscillation. The regularity of these oscillations has been put to practical use in timekeeping mechanisms in which the pendulum serves to restrict a clock escapement movement to regular periods, thus providing timekeeping accuracy. The grandfather and coo-coo clocks, for example, both pendulum-regulated, are known for their timekeeping abilities as well as for their special attractiveness.

However, the public's fascination with the pendulum extends beyond the regularity or periodicity of the pendulum swing to fix itself on the motion exemplified by the swing. Movement in itself is a strong visual attraction, a fact capitalized on by the use of dummy pendulums in clocks. Such clocks are regulated by means other than pendulum periods, and incorporate a pendulum or a simulation of a pendulum for ornamental purposes only.

To date, every commercial use of pendulum motion, natural or simulated, has capitalized on the regular periodic swing of the pendulum. But when used to attract attention, such regularity tends to defeat itself; for, by becoming usual, a constant back and forth movement tends to blend into the background and ultimately to become the very background from which it was intended to stand out. The present invention, however, as explained above takes advantage of the normally expected periodic or oscillatory motion of a pendulum and by making the motion aperiodic or arrhythmic takes advantage of such unexpected departure from regular motion to attract and, depending upon the sophistication of the unexpected motion, hold an observer's attention. Further details and advantages of the invention will become evident from the following more particular description in which:

In FIG. 1 there is shown schematically in partially broken away elevation an arrangement for a pendulum type device 10 in accordance with the invention. In FIG. 1 a pendulum 11 is shown comprised of a pendulum bob 13 supported on a suspension line 15 dependent from a pendulum support 17. The base 19 of the pendulum device 10 is broken away to reveal a schematic operating arrangement including a motor 21 having a shaft 23 which carries upon the ends of a rotatable arm 25 two electromagnets 27. Motor 21 is regulated by a controller 29. The controller 29 also activates the two electro-magnets 27 alternately as they are carried in a circle upon the rotatable arm 25 with the rotation of the shaft 25. The two electromagnets therefore act as impulse or energization devices for the pendulum bob 13 and keep it continuously oscillating without losing energy and, as a result, from slowing down and stopping. Since, however, the two electromagnets are progressively carried in a slow circle about the top surface of the device 10 the pendulum bob 13 is continuously deviated circumferentially in its oscillations. Normal deviation of a pendulum trajectory due to terrestrial rotation will cause the pendulum to make one circle every twenty four hours as the earth rotates beneath the oscillating pendulum. However, the shaft 23 of the motor 21 will be regulated to rotate significantly faster than one rotation every twenty four hours. One rotation every ten or fifteen minutes or less will be found eye-catching to passers by. Any suitable known electronic circuits may be used in controller 29 to time the energization of the electromagnets which must be operated in time with the normal oscillation of the pendulum between the magnets. As will be explained presently, it is also necessary as a practical matter for the electromagnet to take control of and, at least momentarily, halt the oscillating motion of the pendulum.

FIG. 2 is a partially broken away plan view of the pendulum device shown in FIG. 1. The top of the base is schematically shown particularly in FIG. 1 as being concave. The face need not be concave as shown, but the concavity allows the pendulum to swing close to the face. Otherwise the pendulum bob would tend to rise above the face at the sides requiring a more powerful electromagnet to exert the same force upon the pendulum. There is thus considerable advantage to having an arcuate or dish shaped top or face on the clock casing allowing the electromagnets to be disposed as close as possible to the pendulum at the extremities of its oscillation.

The operation of the device shown in FIGS. 1 and 2 is basically dependent upon the size of the device which determines broadly the length of the pendulum suspension 15. Upon initiation of a pendulum oscillation plus activation of the timing device the pendulum bob will swing toward one or the other of the electromagnets, which will have an off period calculated to be somewhat less than one or more swings of the pendulum from one end of its oscillation to the other. In the simplest sequence of operation the timing device will energize the electromagnets 27 alternately as the pendulum approaches such electromagnet. Since the electromagnets move to the side on the rotary arm 25 in proportion to the passage of time, as the pendulum bob 13 approaches the end of its swing it is deviated progressively to the side of its normal oscillation trajectory until it halts over or adjacent to the nearest electromagnet. The pendulum is then held extended on its suspension until the electromagnet 27 is deenergized by the timer. The holding time may be any period desired, from only a momentary halting, to a significant period of time. The electromagnet is then deenergized and the pendulum is released and will swing away from the electromagnet toward the other electromagnet in accordance with its normal oscillation period. At least a momentary halt over or adjacent to the electromagnet is required so that such new oscillation of the pendulum will be completely separate from the previous oscillation. Otherwise, since the pendulum is deviated to the side during the last portion of its swing as it approaches the electromagnet, the pendulum would assume an increasing elliptical trajectory with each energization of the electromagnet. This would cause the electromagnet to eventually lose control of the pendulum bob due to an increasingly erratic path. On the other hand, so long as the pendulum bob is held stationary at least momentarily, the period of holding as related or compared to the period of energization of the electromagnet can be as abbreviated or extended as desired. When the electromagnet is deenergized the pendulum will swing away with a new and substantially straight trajectory. Since the device is a display device meant to attract attention, however, the period of holding should not be too long or the interruption in the normal pendulum oscillation will lose its attention attracting character. If the pendulum bob was, for example, drawn by the moving electromagnet all the way around the circumference of the device without periodic cross oscillations it would not retain significant attractiveness.

Variations in the sequence of timing the electromagnets 27 may also be used. For example, instead of alternately energizing the electromagnets 27, each electromagnet may be energized only after one full oscillation or even several oscillations of the pendulum. Alternatively only one of the electromagnets may be energized or even present on the rotary arm. Other variations in the energization pattern are also possible.

FIG. 3 shows in broken away elevation another embodiment of the pendulum device of the invention in which a series of electromagnets 31 are arranged just under the upper surface of a pendulum device along the outer circumference of such device. The pendulum portion of FIG. 3 is substantially the same as the pendulum portion of FIG. 1 and, other than for the electromagnets, the same reference designations are used for the same parts and structures in both figures.

FIG. 4 is a broken away plan view of the arrangement as shown in FIG. 3. In FIGS. 3 and 4 a pendulum bob 13 will be attracted to the peripheral electromagnets 31 as they are activated one after the other. The timer 33, which may be any suitable electronic timer of known design, is used to activate the electromagnets 31 alternately so that the pendulum bob is attracted first to one side of the pendulum device and then to the other side of the pendulum device. At the same time, since the electromagnets are activated in rotation, the magnetic field of the electromagnet which is activated is in effect shifted slightly to the position of the next adjacent electromagnet 31 in line so the pendulum bob is attracted to such next adjacent electromagnet. As schematically seen in FIG. 3, each electromagnet 31 is connected by a separate lead 35 to the timer 33. A common return lead, not shown, may connect each electromagnet 31 with the timer 33. By the use of the apparatus shown in FIGS. 3 and 4 the pendulum bob 13 is again given a circular progression of oscillating movement similar to that effected when the device of FIGS. 1 and 2 is operated and the pendulum bob will move in a general circular pattern which is eye-catching to the observer because it deviates to the side to an extent which almost all observers will recognize as abnormal. The timing sequence will substantially be the same as in the embodiment shown in FIGS. 1 and 2.

FIGS. 5 and 6 show still a further embodiment of the invention similar to the electromagnet arrangement shown in FIGS. 3 and 4. FIG. 5 is a broken away elevation of such embodiment and FIG. 6 is a broken away plan view. In FIGS. 5 and 6 electromagnets 37 are arranged along the edge or just beyond the edge of the concave top surface of the base of the apparatus in a manner similar to that shown in FIGS. 3 and 4. In addition the pendulum suspension 25 is supported from a suspension point 36 in the center of a transparent glass or plastic dome 38 which completely covers and protects the entire oscillation path of the pendulum and isolates it from outside disturbing influences. As in FIGS. 3 and 4 the electromagnets 37 are operated by means of a timer 39 which will cause an alternate energization or activation of opposite electromagnets plus a gradual apparent progression of the activated electromagnet or magnetic field along the edge of the device. The timer 39 will also be arranged and constructed so that it continues energization of electromagnets 37 longer than is necessary to add energy to the pendulum so that the magnetically permeable pendulum bob 13 swings to one side and then stops, being attracted to the adjacent electromagnet until such electromagnet is deenergized, at which time the pendulum bob then swings to the other side. The amount of time during which the electromagnets are energized may thus be varied in any convenient pattern and the pendulum bob will swing with an apparent erratic or at least abnormal or aberant pendulum pattern. Such sudden interruptions of the normal oscillation of a pendulum are, needless to say, quite eye-catching to the observer. The timers 33 and 39, shown schematically in the above described FIGS. 3, 4, 5 and 6, which timers control the periods during which electric current energizes the solenoid or other device that delivers current to the appropriate electromagnet or electromagnets, can be any one of a number of commercially available timers that are manually adjustable to switch electric current on an off regularly for "on" periods of from approximately 0.5 seconds to five or more minutes. The timer's "off" period should last for at least approximately 0.25 seconds and should preferably also be adjustable.

A simple but easily adaptable mechanical timing circuit suitable for coordinating and timing energization of the series of electromagnets 31 in FIGS. 3 and 4 or 37 in FIGS. 5 and 6 is illustrated in FIG. 6 of U.S. Pat. No. 1,938,417 to Curran for progressively illuminating the face of a clock. The electromagnets of the present invention can be easily substituted for the incandescent lamp fixtures shown in the circuit of the patent. The relative length of the energization of the electromagnet and/or the number of electromagnets can be easily accommodated by increasing the number and/or varying the length of the individual contact segments 45 of the patented timer. Normally the contact arm of the patent may make a complete circle each hour, but this obviously may be varied along with the individual lengths of the contact segments 45. It will be obvious that various other known timing arrangements, some considerably more sophisticated than that shown, could be substituted for the timer shown in the patent to perform an equivalent function or job. Among such sophisticated timing devices would be state of the art solid state electronic timers.

In FIG. 7 there is shown schematically a further embodiment of the invention in which a pendulum bob 13 oscillates within a framework or support 41 which has two electromagnets 43 and 45 positioned oppositely. An interchangeable disc type cam 47 is driven by a synchronous electric motor 49 through a belt drive 51. A cam follower 53 is arranged to ride upon the cam disc 47. As the follower 53 moves in response to the peaks and valleys 55 and 57 respectively of the cam 47, alternative electrical circuits **59*a* and 59*b* are caused to be opened or closed through the agency of switch means 61 activating electromagnets 43 and 45 alternately from the power source 63 shown here in the form of a battery. A second switch 62 serves to activate or deactivate the electromagnet circuits 59*a* or 59*b* as a whole. Opening switch 62** deactivates the entire electromagnet circuit.

In the arrangement shown in FIG. 7 two electromagnets are provided on opposite sides of a framework or support. As seen the cam disc 47 determines essentially which electromagnet 43 or 45 is activated and for how long, the peaks 55 of the cam 47 being effective to activate circuit **59*a* and electromagnet 43 for as long as the peak or plateau extends and the valleys 57 of the cam being effective to activate circuit 59*b* and electromagnet 45 for the extent of such valley. Any portion of the cam of intermediate height will not close the double action or double throw switch 61 on either side and neither of the circuits 59*a* and 59*b* and electromagnets 43 and 45** will then be activated. However, the device can be operated without essentially intermediate height areas and this is basically the arrangement shown.

Figure 8:
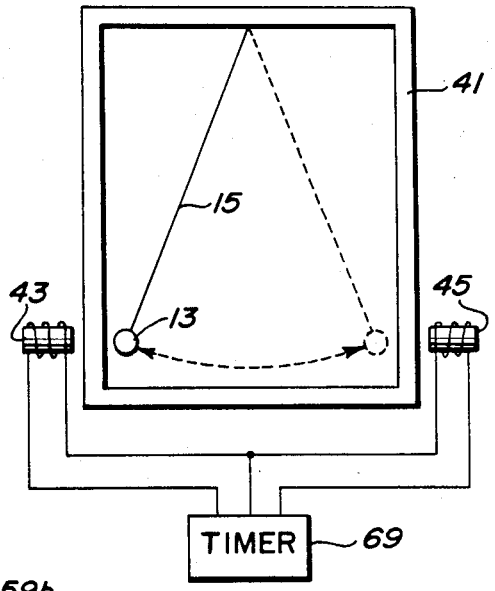
FIG. 8 is a schematic diagram of a still further embodiment of the invention including an electronic timer arrangement.

FIG. 8 shows a still further embodiment of the invention in which an arrangement similar to that shown in FIG. 7 is instead of being provided with a mechanical cam type arrangement as shown in FIG. 7 is in its place provided with an electrical or electronic timer 69 of any suitable known construction and design. The remainder of the device is substantially similar to that shown in FIG. 7 and its operation will also be similar.

Figure 9:
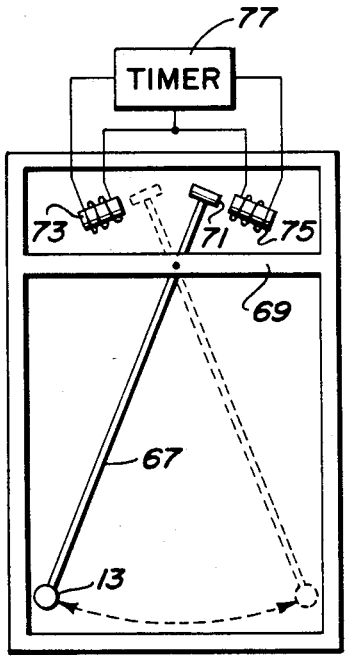
FIG. 9 is a schematic diagram of a variation of the embodiment of the invention shown in FIG. 8

FIG. 9 shows still another embodiment of the invention which is substantially similar to the embodiment shown in FIG. 8 except that the pendulum bob 13 instead of being supported upon a flexible line 15 as in FIGS. 7 and 8 is instead supported upon a rigid rod arrangement 67, which is pivoted on a cross member 69 in the apparatus. The upper end of the rigid pendulum bob support 67 is provided with a permanent magnet 71 or a form of ferro or other magnetic material designated by the same reference numeral. Electromagnets 73 and 75 which are activated by the timer 77, interact with the permanent magnet or magnetic material 71 to maintain the swing or alter the period of swing of the pendulum bob 13 from side to side.

FIG. 10 illustrates one of an infinite number of the cam tooth definitions which when translated through the perimeter of the disc cam shown in FIG. 7 will generate an arrhythmic pendulum oscillation. The cam tooth definiton illustrated linearly in FIG. **10*a* graphs the periods of energization and deenergization, in terms of seconds, of the electromagnets 43 and 45. FIG. 10*b* graphs the pendulum swings or oscillations as required or controlled by the cam operation shown in FIG. 10*a*. It should be noted that at the node points at which the tooth profile line crosses from E to W or W to E deenergization of the appropriate electromagnet occurs and thereafter energization switches from one electromagnet to the other, i.e. from electromagnet 43 to electromagnet 45** or vice versa, releasing the pendulum to swing from the one electromagnet toward the other electromagnet.

Figure 11:
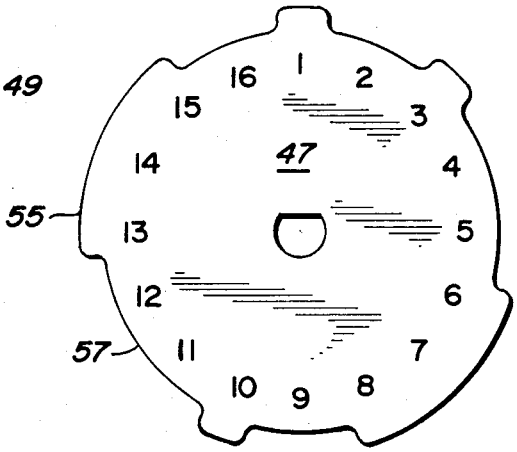
FIG. 11 shows the cam of FIG. 7 enlarged with second timing indicated thereupon.

To illustrate, referring to FIGS. **10*a* and 10*b*, at the three second point, electromagnet 45 is energized and the pendulum is in the process of swinging toward electromagnet 45. As the cam follower, see FIG. 11, approaches the cam node at 3.5 seconds, the pendulum has reached its maximum swing and the pendulum bob is drawn and held momentarily by the energized electromagnet 45. At the 3.5 second point, the cam follower crosses the cam node causing energy to be switched from electromagnet 45 to electromagnet 43. The deenergization of electromagnet 45 at this point releases the pendulum to begin its swing toward electromagnet 43 which now becomes energized in time to attract the pendulum bob. The pendulum reaches electromagnet 43 just before the 4.5 second point. The pendulum is then retained at the end of its swing by electromagnet 43** until approximately 5.5 seconds when the magnet is switched off or deenergized.

Note that the electromagnet at either end of the pendulum swing must be energized to receive the pendulum bob each time said bob approaches. The apparatus could be arranged to provide energy every few swings also. Without such constant re-supply of energy, the pendulum cannot maintain its swing whether the swing sequence is regular or arrhythmic. In order for the pendulum oscillation to be eye catching, furthermore, the pendulum must be caught and held at the end of at least some of its oscillations for a greater or lesser period.

Figure 12:
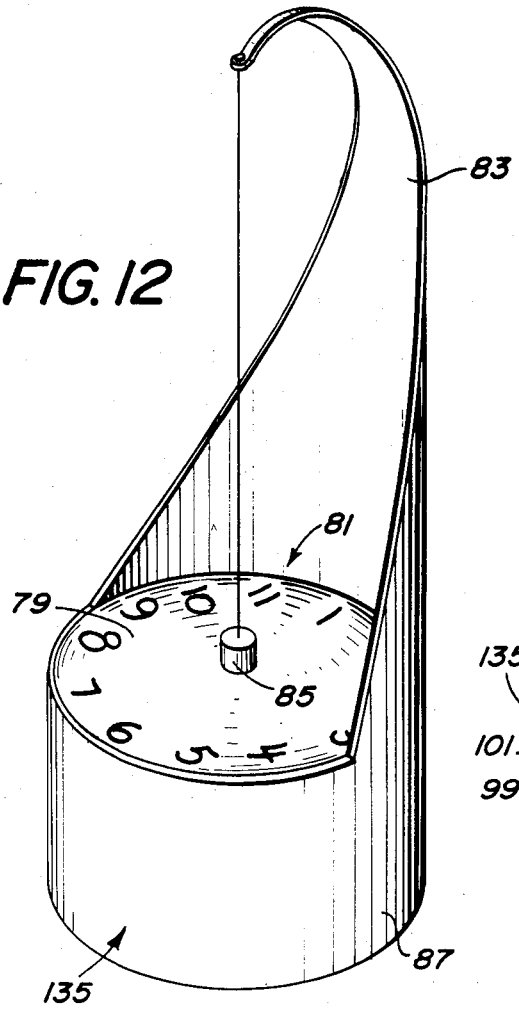
FIG. 12 the pendulum arrangement of the invention applied to a clock or horological device.
Figure 13:
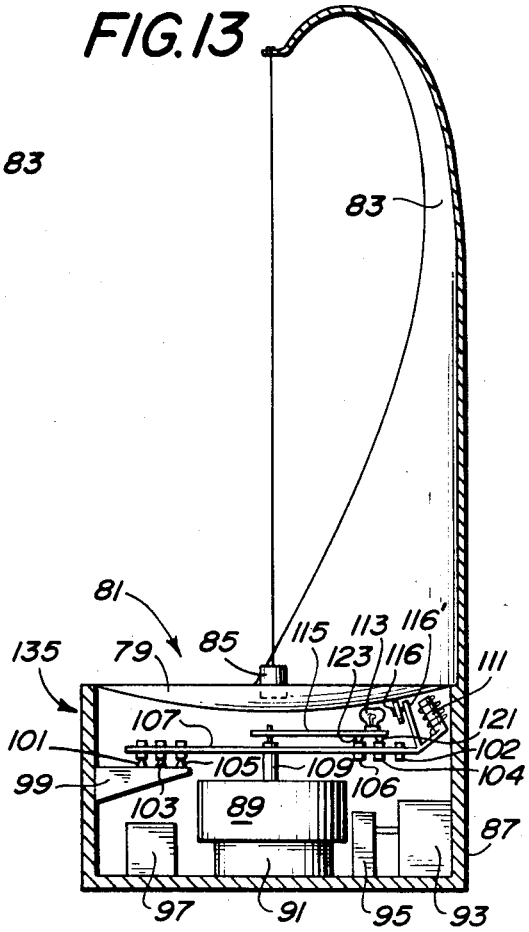
FIG. 13 shows a partially cut away view of the clock arrangement of FIG. 12.

FIGS. 12 and 13 show the pendulum arrangement of the invention applied to use with a horological mechanism. FIG. 12 is an isometric view and FIG. 13 is a cross sectional elevation of a form of clock in which an arrhythmic pendulum swings over the face of the clock and coincidentally may aid in indicating the time. The pendulum bob is supported directly over the center of the face 79 of a clock 81 from a sculptured pendulum support arm 83. The pendulum bob 85, as shown in FIG. 12, swings back and forth over the clock face 79 in time with the movement of the clock hands or other time indicating means. The swinging of the pendulum bob is eye-catching and amusing to those using the clock. In FIG. 13 the base 87 of the clock is broken away to show the interior in which the clock casing 135 as seen in FIG. 12 houses a clock mechanism indicated broadly as 89, a motor 91, power source 93 which may be in the form of a battery, a timer 95, and a relay 97. A power supply support 99 is connected by conventional means, not shown, to the power source 93 and supplies power through brushes 101, 103 and 105 to three conductive bands 102, 104 and 106 which forms a part of a rotatable power disc 107. Power disc 107 is mounted on a rotational axis or shaft 109 of the clock mechanism 89. An electromagnet 111 may be mounted either on the edge of the power disc 107 as preferred so that it moves with the time indicator mechanism, or may be mounted rigidly under the clock face. If the electromagnet 111 is mounted on the time indicating means, as shown, the pendulum bob and its swings will be attracted to different portions of the face of the clock as the time changes and will hesitate there long enough to indicate the time. Preferably this will be the time in minutes. The hesitation or delay of the pendulum swing will, furthermore, be eye-catching to the observer. On the other hand, if the electromagnet is mounted on a fixed portion of the face of the clock, the pendulum bob will be attracted to the same portion of the face of the clock during all its swings. In either event, the electromagnet can be alternately energized and deenergized in a predetermined pattern provided by the timer means 95 so that the pendulum bob will be attracted arrhythmically to the electromagnet and will, if the electromagnet moves, swing arrhythmically around the face of the clock, thus serving as an attractive attention getter. An electric lamp 113 is provided on an hour hand 115 to indicate the time in hours. The lamp 113 preferably stays lighted at all times and normally makes one complete circuit of the clock dial in 12 hours. A separate minute hand may also be supplied, particularly if the pendulum is not designed to move laterally about the clock face. The face 79 of the clock 81 is preferably concave as shown particularly in FIG. 13 to allow the pendulum bob 85 to swing closer to the face and the electromagnet 111. However, if the clock is designed to have time indicating hands positioned above the face in conjunction with the pendulum, such face may be flat. A more powerful electromagnet may then be neessary, however, since the path of the pendulum bob will carry it further from the top of the clock face at the end of its swing.

Figure 14:
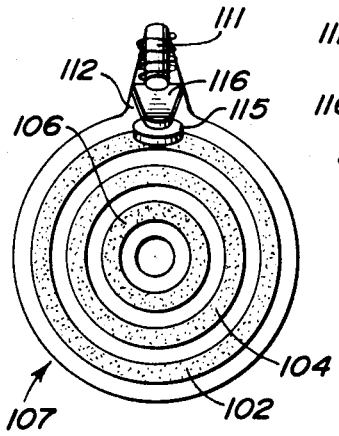
FIG. 14 is a plan view of the power disk shown in FIG. 2.
Figure 15:
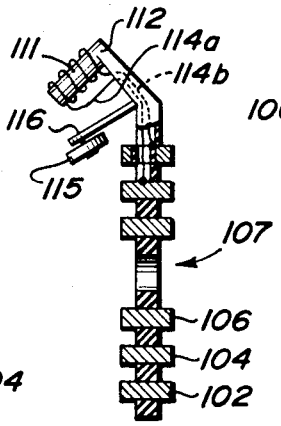
FIG. 15 is a side view of the power disk of FIG. 14.

FIG. 14 is a plan view of the power disk 107 showing the three electroconductive (E.C.) bands 102, 104 and 106 and the electromagnet 111 mounted on the power disk 107 on an arm 112. FIG. 15 is an enlarged side view of the power disk 107 and attached electromagnet support arm 112 and electromagnet 111. Electrical leads **114*a* and 114*b* are shown connecting the coil of the electromagnet 111 to conductive bands 104 and 106. There is also preferably a support or bearing wheel or roller 116 mounted upon an arm 116' attached at its base to the arm 112 in a position such that the roller 116 contacts the lower surface of the clock face 79 to relieve some of the off center force upon the power disk 107 when the electromagnet 111 is activated and the magnetic field draws the pendulum bob 85 and the electromagnet 111 toward each other. Such force is particularly strong when the pendulum bob 85 is drawn adjacent to the electromagnet 111**.

Figure 16:
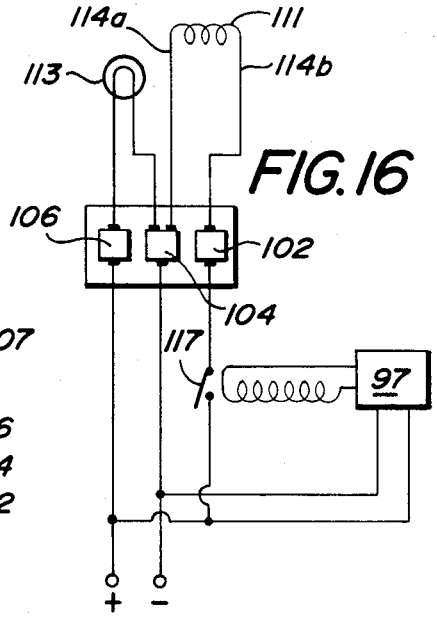
FIG. 16 is a schematic circuit diagram for the clock of FIGS. 12 and 13.

FIG. 16 is a schematic wiring diagram showing the essential circuitry for operation of the apparatus shown in FIG. 13. In FIG. 16 the power supply, which may be either a D.C. or A.C. power supply 93, is connected via brushes 101, 103 and 105 shown in FIG. 13 with electroconductive bands 102, 104 and 106 shown schematically in FIG. 16. If an A.C. power supply is used, a suitable rectifier will be necessary to convert to D.C. for use with the electromagnet. The bands 104 and 106 are directly connected to the positive and negative terminals of the power supply 93 via the brushes 121 and 123 shown in FIG. 13 while the third band 102 is connected to the positive terminal of the power supply 93 through an interrupt switch 117 which is operated by relay 97. The interrupt switch 117 is periodically activated by timer 95 shown in FIG. 13. When the timer 95 activates relay 97 it in turn closes switch 117 and current is passed via electrical brush 101 to the outer E.C. band 102. Leads **114*a* and 114*b* from the ends of the coil of electromagnet 111 (which is shown only as the solenoid coil portion of the electromagnet in FIG. 16) are connected to bands 104 and 102 so that when the switch 117 is closed the electromagnet 111, which is carried around on the arm 112 attached to the power disc 107, just below the clock face 79, is activated or energized. At the same time the illuminated means or electric lamp 113 is continuously activated through brushes 121 and 123 shown in FIG. 13 which are in electrical contact with E.C. bands 104 and 106. The E.C. band 104 i.e., the middle E.C. band, is the return line in each case for current both from the electromagnet 111 and from the lamp 113 to the power source 93** to complete the circuit.

FIG. 17(*a*) shows a different application of the arrhythmic pendulum arrangement of the invention. In FIG. 17(*a*) an elevation of a clock 125 in the form of a dummy grandfather's clock, i.e. a grandfather's clock in which the pendulum is provided for decoration rather than to regulate the clock, is shown. Clock 125 is comprised of a casing 127 with a clock face 129 in the upper portion and the usual pendulum recess or opening 131 in the lower portion in which recess there is suspended a pendulum 133. Pendulum bob 135 of pendulum 133 is shown at one end of one of its cross-wise oscillations at a time indicated below the clock as thirty-five minutes and one second past three o'clock (3:35:01).

It will be understood that suitable electromagnets, not shown, are provided preferably on both sides of the casing in position to attract and hold the pendulum bob 135 when one or the other of the electromagnets is activated and the pendulum is within effective attractive range of the appropriate electromagnet. Since the pendulum is used in connection with a grandfather's clock where the pendulum normally swings only in a single vertical plane from side to side, the arrhythmic motion is in time and not in space and time. In other words, the arrhythmic component of the pendulum oscillation is an unexpected interruption or halting of the pendulum motion at the extremities of the pendulum's swing at one or both ends of its oscillation. The pendulum motion may be interrupted at the extremity or extremities of every oscillation or every few oscillations.

FIG. 17(*b*) is an example of one possible pattern of arrhythmical oscillation of the pendulum. In FIG. 17(*a*) the pendulum is depicted as indicated above at one side of the casing at a time indicated below the clock as thirty-five minutes and one second past three o'clock (3:35:01). The series of pendulum positions shown in FIG. 17(*b*) will be understood to be consecutive one second interval schematic representations of consecutive positions of the pendulum. It will be noted that at thirty-five minutes and two seconds past the hour (3:35:02) the pendulum is still in its initial position, obviously still held by the electromagnet in the side of the clock casing. After the passage of an additional second, i.e. at 3:35:03, the pendulum is still held by the magnet. However, at 3:34:04 it will be seen that the pendulum has swung to the other side. At 3:35:05 the pendulum has swung back to the first or left (as viewed by the observer) hand side of the clock. At 3:35:06 the pendulum is still held on the left hand side of the clock casing. At 3:35:07, however, the pendulum has swung again to the other or right side of the casing and at 3:35:08 the pendulum is still on the right side of the casing. It will be recognized that the pendulum 133 exhibits within the framework of the short period depicted in FIG. 17(*b*) an aperiodic movement with different intervals or time periods of suspension of motion at the extremities of the oscillations. Such movement will appear highly irregular to the observer and will tend to attract the attention and interest of anyone who is familiar with the usual regular oscillations of the pendulum in a grandfather's clock.

In each of the embodiments shown in the accompanying Figures and described above it is necessary at some point to initiate the motion of the pendulum. This is in most cases easily done since the power need only be turned on by operation of an appropriate switch, which it has not been thought necessary in most cases to illustrate, by plugging in the power source or the like. The appropriate timing means will then begin energizing the electromagnets in appropriate order. At this point the pendulum may be manually biased to the side toward one or the other of the electromagnets sufficiently such that the effective magnetic field of the magnet when activated in turn will be sufficient to take control of the pendulum bob. The apparatus will thereafter continue to operate in its predetermined sequence. The pendulum bob can be biased toward the electromagnet by physically grasping the pendulum and thrusting it toward the magnet or by tilting the casing or housing of the apparatus so that the effects of gravity draw the pendulum bob to the side toward an appropriate electromagnet. Of course, a mechanical biasing means or device of suitable design could also be incorporated into the apparatus to aid in initial deviation of the pendulum. Once operation is initiated the device of the invention will continue to cycle through its predetermined program as long as sufficient power is supplied.

It will also be evident that while the invention has been shown and described in the form of a base from which a pendulum support extends and in which the electromagnets are housed, various other arrangements could be used. For example, a separate support could be used and in a large installation the pendulum could even be supported from an existing overhead structure such as the ceiling of a room in which the base incorporating the timing mechanism and the electromagnets is contained. The support for the pendulum, therefore, may only be associated with, rather than directly physically connected to, the base. It will also be evident that the base rather than comprising a physically separate structure could comprise an addition to as well a portion of an already existing structure such as, for example a table or a counter or even the floor of a room in which the electromagnets and timing mechanism could be inset.

It will be seen from the above description and appended drawings, that the instant invention provides a device for effecting an unusual motion of a pendulum which may be used as an attention attractant or an attractive and decorative pendulum device. The device consists substantially of a suitable arrangement of a pendulum bob and means for connecting the bob to a suitable pivot point plus an electromagnet or similar magnetic means positioned at one intended apex or electromagnets or similar magnetic means positioned at both intended apexes of the swing of the pendulum bob, plus a timing mechanism designed to energize or deenergize the electromagnet or electromagnets in a sequence determined basically by the natural period of the free swing of the pendulum except that either the natural period or natural direction of the pendulum swing is interferred with in an arrhythmic or aperiodic manner which will attract the attention of any one seeing the pendulum operate. Mounted within a suitable framework such as, for example, within a clock housing, the device attracts attention by appearing as an aberant pendulum which, instead of swinging back and forth in a normal or regular pendular swing sequence or oscillation, swings arrhythmically or aperiodically, depending upon the chosen timing sequence.

The normal oscillations of the pendulum are interferred with, apparently aberantly, in either time, i.e. by being interrupted or halted for a greater or lesser period or time at the end of one or more oscillations before resuming an oscillatory movement, or in both time and space, i.e. by being biased to the side or moved laterally with respect to the transverse oscillation of the pendulum and then held at the end of one or more oscillations before being allowed to resume the normal oscillation or swing of the pendulum. If the motion is interferred with only in time, the halt must be sufficient to appear aberant to the observer. If the motion is interferred with in both time and space, the amount of interference with respect to the two may be in inverse ratio, i.e. if the interference in space is very little, the observer will have his attention attracted by the interference with the smooth oscillation of the pendulum in time and vice versa, if the interference in space is sufficient, the interference in time can, but need not necessarily be, very small. Some interference in time, i.e. interruption of the normal oscillation is, however, necessary as described above in order to avoid loss of control of the pendulum.

While it will be understood that the invention has been described in considerable detail in connection with the above drawings and explanations of the various embodiments illustrated, the invention is not to be limited to the particulars of any such embodiments, but is to be construed broadly with reference to the language of the appended claims so as to provide the broadest possible interpretation of such claims in view of the prior art and thereby to effectively encompass the intended scope of the invention.

I claim:

1. A pendulum type display device comprising:
(a) a base having a peripheral portion and a central portion,
(b) a pendulum support associated with said base,
(c) a pendulum suspension connected to said support,
(d) a pendulum bob connected to said pendulum suspension, said bob being formed of a magnetizable material,
(e) electromagnetic means positioned adjacent the peripheral portion of said base and the normal outer extent of an oscillation of said pendulum bob,
(f) timing means to activate said electromagnetic means to attract and temporarily retain the pendulum bob at the end of an oscillation of said pendulum bob and to deactivate said electromagnetic means after a period of activation to release and allow said pendulum bob to swing away from the vicinity of said magnetic means.

2. A display device according to claim 1 additionally comprising a plurality of electromagnetic means arranged in a pattern adjacent the peripheral portion of the base and timing means to activate said electromagnetic means to attract and at least momentarily retain said pendulum bob in a predetermined order.

3. A display device according to claim 1 additionally comprising mobile means to transport the electromagnetic means in a predetermined path adjacent the peripheral portion of the base and wherein the timing means is arranged and constructed to activate the electromagnetic means at a series of predetermined positions adjacent said peripheral edge to attract and at least momentarily retain the pendulum bob in such positions in a predetermined order.

4. A display device in accordance with claim 3 wherein the mobile means transports the electromagnetic means in a path substantially adjacent the perimeter of the upper surface of said base.

5. A display device in accordance with claim 4 in which there are two or more electromagnetic means.

6. A pendulum type display device comprising:
(a) a base,
(b) an elevated support member extending from said base,
(c) a linear pendulum suspension member movably connected to said support member,
(d) a pendulum bob attached to the end of said suspension member,
(e) electromagnetic means positioned to influence oscillation of said pendulum adjacent the extremity of said oscillation,
(f) means to activate said electromagnetic means with respect to said pendulum and to deactivate said magnetic means with respect to said pendulum near the ends of its oscillations in a pattern which noticeably disturbs the normal oscillation of the pendulum.

7. A pendulum type display device according to claim 6 wherein there are two or more electromagnetic means and the means to activate and deactivate said electromagnetic means is arranged and constructed to accomplish said activation and deactivation in a predetermined pattern.

8. A pendulum type display device according to claim 7 wherein the electromagnetic means are fixedly mounted.

9. A pendulum type display device according to claim 6 wherein the electromagnetic means is carried on a moving support in a position to attract and retain the pendulum at the extremities of certain of its oscillations.

10. A pendulum type display device according to claim 9 wherein there are more than one electromagnetic means carried on the moving support.

11. A pendulum type display device according to claim 10 wherein the means to activate and deactivate the electromagnetic means is arranged and constructed to do so in a predetermined pattern.

12. A pendulum type display device according to claim 8 wherein the means to activate and deactivate the electromagnetic means is arranged and constructed to do so in a predetermined pattern.

13. A pendulum type display device according to claim 11 wherein the predetermined pattern can be varied by adjustment.

14. A pendulum type display device according to claim 12 wherein the predetermined pattern can be varied by adjustment.

15. A method of using a pendulum as a display device comprising:
(a) commencing oscillation of the pendulum,
(b) magnetically attracting the pendulum near the extremity of certain of its oscillations to disturb such oscillation to such an extent as to attract the attention of a casual observer to the aberrant motion when compared to the normal oscillations of a pendulum while at the same time adding to the potential energy of oscillation of the pendulum, and
(c) interrupting the magnetic attraction to allow the pendulum to resume its normal oscillations.

16. A method in accordance with claim 13 wherein motion of the pendulum is magnetically deviated with respect to its motion in time.

17. A method in accordance with claim 13 wherein the motion of the pendulum is magnetically deviated from respect to its motion both in time and in space.

* * * * *